US005281082A

United States Patent [19]

Ghilardi

[11] Patent Number: 5,281,082

[45] Date of Patent: Jan. 25, 1994

[54] APPARATUS FOR TRANSFERRING STACKS OF SERVIETTES FROM A PILE FED BY A FOLDING MACHINE TO A CONVEYOR

[75] Inventor: Mauro Ghilardi, Pieve S. Paolo, Italy

[73] Assignee: Fabio Perini S.p.A., Lucca, Italy

[21] Appl. No.: 914,208

[22] Filed: Jul. 15, 1992

[30] Foreign Application Priority Data

Jul. 23, 1991 [IT] Italy ..... FI/91/A-184

[51] Int. Cl.[5] ..... B65G 59/00

[52] U.S. Cl. ..... 414/798.9

[58] Field of Search ..... 414/788.5, 798.9, 778, 414/796, 796.4, 913, 797.9, 795.4, 795.8; 221/195, 226, 239, 210

[56] References Cited

U.S. PATENT DOCUMENTS 3,451,521 6/1969 Fehst et al. ..... 414/798.9
4,611,705 9/1986 Fluck ..... 414/798.9
4,869,359 9/1989 Müller et al. ..... 414/796

FOREIGN PATENT DOCUMENTS 2427635 12/1976 Fed. Rep. of Germany .
3629802 3/1988 Fed. Rep. of Germany ... 414/795.8

OTHER PUBLICATIONS

Research Disclosure No. 132, Apr. 1975, p. 43.

*Primary Examiner*—David H. Bollinger
*Assistant Examiner*—Carol Wallace
*Attorney, Agent, or Firm*—Francis J. Bouda

[57] ABSTRACT

An apparatus for transferring stacks of folded articles such as serviettes or the like, from a pile to a conveyor (3) includes retaining teeth (77) which retain the first article of a stack (P) and which are moved by the advancement of the articles. A separator (47,51) to separate the first stack (P1) of articles from subsequent stacks (P2) and a discharger (83) to discharge each single stack onto the conveyor (3). The separator includes a first separating member (51) arranged to move between two adjacent stacks (P1, P2) of articles, and a second separating member (47), operating in conjunction with the first separating member (51), which also moves between the same two adjacent stacks of articles. The second separating member is provided with a further motion to move the first stack (P) away from the subsequent one (P2) and hold it prior to the discharge thereof onto the conveyor (3).

13 Claims, 9 Drawing Sheets

APPARATUS FOR TRANSFERRING STACKS OF SERVIETTES FROM A PILE FED BY A FOLDING MACHINE TO A CONVEYOR

The invention refers to an apparatus for transferring stacks of folded articles, such as serviettes or the like, from a column to which the articles are fed by a folding machine, towards a conveyor, the apparatus comprising in combination: retaining teeth to retain a stack of the column which teeth are moved by the advancement of the articles; separating means to separate the first stack of articles from the subsequent stack and discharge means to discharge each stack as a pile onto the conveyor.

For the production of serviettes or similar articles, machines are known which, starting from a reel of web material, such as creped paper, provide for unwinding the web material, folding it along a longitudinal central line and then along equidistant transversal lines and cutting the obtained product along a central line. Therefore, at the output of the machine, there are available two columns of folded articles which must be divided into stacks of a predetermined number of articles. These stacks are then transferred onto a conveyor which carries the individual stacks in piles to a packaging machine. In order to divide the articles of the column into stacks of equal number of articles, the means for feeding the articles are provided with a motion transverse to the advancement of the web material, along a vertical direction, so as to distribute the articles in stepped arrangement and put the first article of each stack at a higher level than the next ones, while the last article of the stack is at the lowest level.

DE-B-2427635 discloses an apparatus for separating stacks of articles from a column being fed by the manufacturing machine, and for discharging the individual stacks on the conveyor which conveys the product to the packaging machine. This known machine is provided with a system of retaining teeth which hold the higher article of each stack coming from the pile, and separate it from a preceding stack. An oscillating articulated system carrying a series of wedge-shaped elements moves between the most advanced stack (i.e., the first of the column) and the stack temporarily held by the system of retaining teeth, so as to temporarily retain the second stack of the column and all the articles which are between this stack and the manufacturing machine. In this condition, the first or more advanced stack is separated from the remaining articles and can be discharged, by the oscillation motion of a support member, onto the conveyor which transfers it to the packaging machine.

This known machine has the disadvantage that each stack of articles discharged each time is not securely held on the side facing the advancing column. This means that the individual articles will likely be wrinkled, thereby deforming the stack. This may bring about defects in the final package. In fact, in this known machine, both the retaining teeth and the wedge-shaped members act only on the frontal surface of the second stack. i.e., of the stack following the one that is to be discharged from the column to the conveyor. The first stack is therefore uncontrolled and often falls apart while it is turning from the vertical position, from which it is removed, to the horizontal position where it is laid down onto the conveyor.

It is an object of the present invention to provide an apparatus of the type mentioned above which overcomes the drawbacks of the traditional apparatuses by allowing, in particular, the obtainment of a more precise and secure transfer system which ensures a high working speed and accuracy of the transfer operations from the column to the conveyor.

Substantially, the apparatus according to the invention is characterized in that the separating means comprise a first separating means which moves between two adjacent stacks of articles, and a second movable separating means operating in conjunction with the first separating member and able to move between two adjacent stacks of articles, and provided with a further motion to move the first stack away from the subsequent one and hold it prior to the discharge thereof to the conveyor. In this way, the first stack of the column, that is, the one ready to be discharged onto the conveyor, is securely held on two sides before being rotated and discharged onto the conveyor. The second separating member moves together with the first stack of the column as it moves away from the remaining articles of the column, while the first separating member restrains or holds back the front of the remaining articles in the column.

Advantageously, to discharge each stack of articles from the column to the conveyor, the discharge means may comprise an oscillating member carrying a first fixed abutment and a second movable abutment, the latter being able to move parallel to the direction of movement of the articles fed to the column. Contrary to the known apparatuses, such as the one described in the above mentioned DE-B-2427635, the apparatus according to the invention may, therefore, be provided with a movable abutment which holds each stack of articles at the back of the stack by accompanying it in its movement towards the fixed abutment, prior to the rotation of the oscillating member into the horizontal position from which the stack of articles is discharged onto the conveyor. In this way, each stack is clamped between the front and back sides during its forward travel in the horizontal direction.

Further advantageous embodiments of the apparatus according to the invention are indicated in the appended claims.

The invention will be better understood by following the description and the attached drawing, which shows a practical, not limiting exemplification of the invention. In the drawing.

Figure 2:
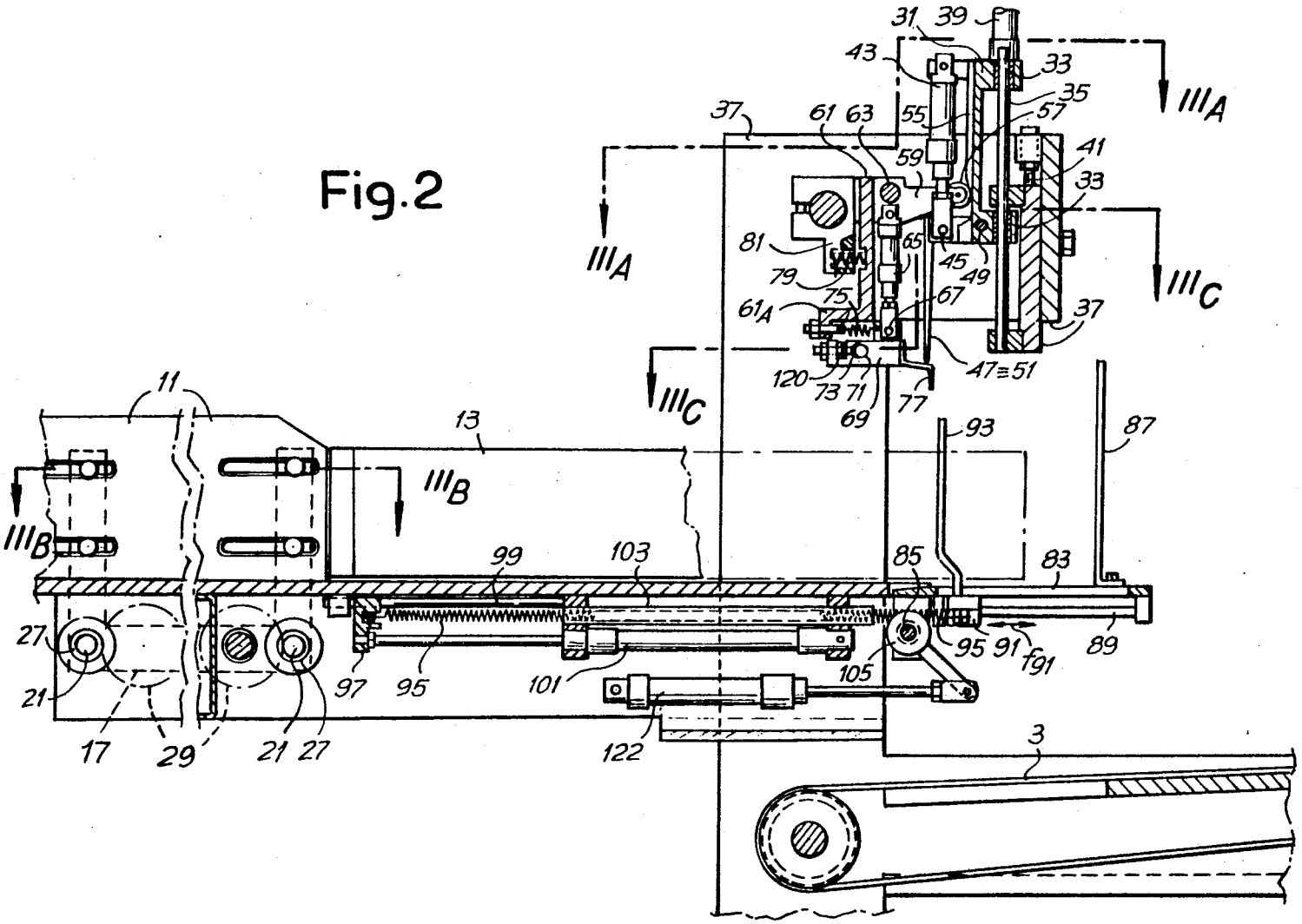
FIG. 2 shows a longitudinal section taken on a vertical plane of the portion of the apparatus containing the separating and discharging means.

FIG. 3—A shows a horizontal section along lines IIIA—IIIA and IIIC—IIIC of FIG. 2.

FIG. 3—B shows a horizontal section along lines IIIB—IIIB of FIG. 2.

FIGS. 4 to 12 show sequential operating cycles of the apparatus according to the invention.

Figure 1:
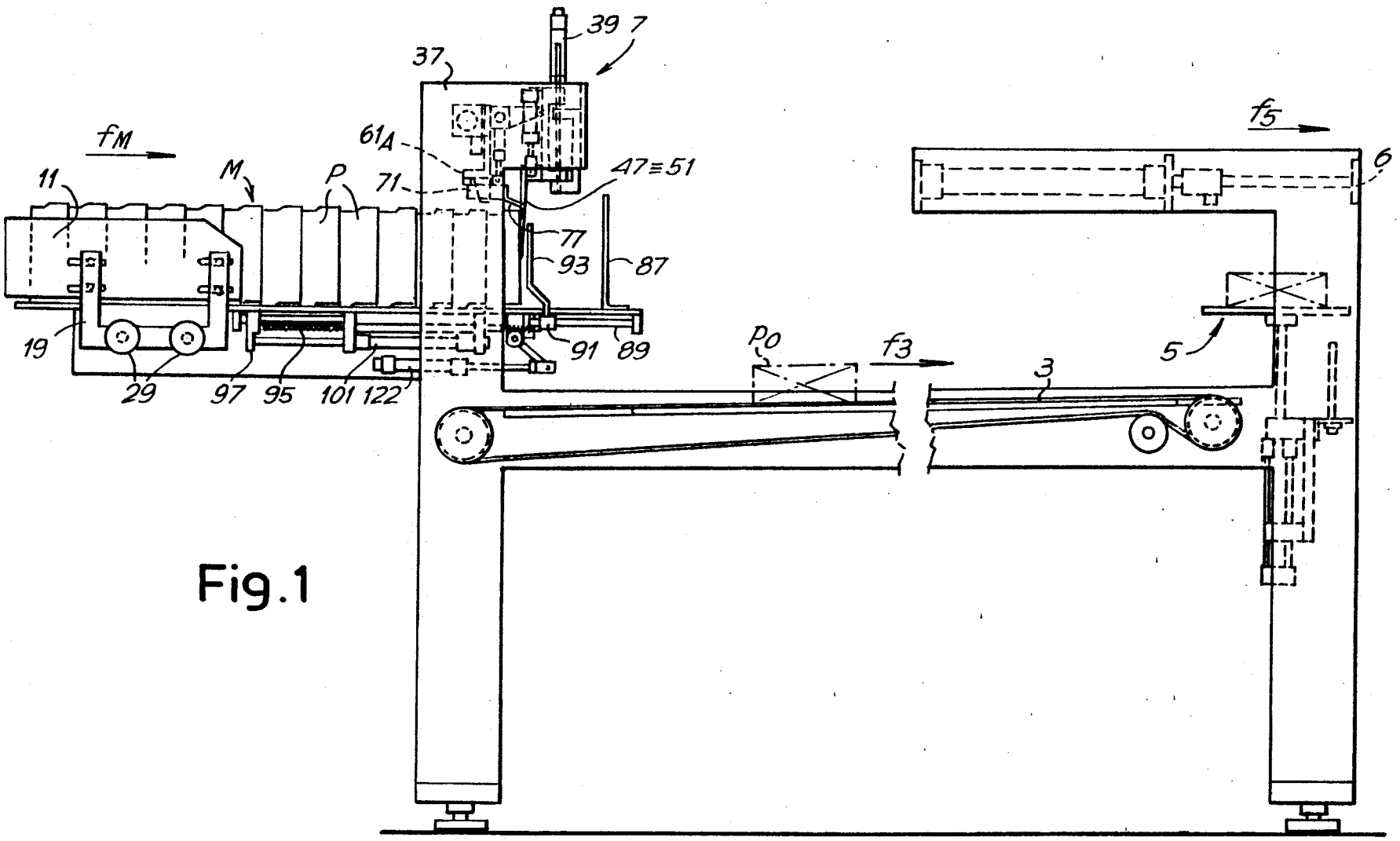
FIG. 1 is a schematic side view of the apparatus according to the invention.

With reference to FIG. 1, M indicates a column of articles, such as folded paper serviettes, moved forwards in the direction of arrow fM by a manufacturing machine (not shown) disposed on the left hand side of the apparatus of FIG. 1. As shown in this Figure, the column of articles M is subdivided into a plurality of stacks defined by a stepped arrangement of said articles. Each stack begins with an article which is at a higher level than the last article of the preceding stack. The adjacent articles from beginning to end are gradually stepped down to the last article of the stack which is in the lowest position. The next article in the column is again disposed at a higher level and represents the beginning of the next stack. This disposition is known per se and is used to subdivide the articles into stacks containing an equal number of articles.

The individual stacks P of vertically arranged articles must be discharged from the horizontal column M onto a horizontally moving conveyor 3 with the articles rotated 90° with respect to their position in the column of articles M, so that the articles lie horizontally and parallel to the plane of the conveyors 3. In FIG. 1, Po denotes a pile of articles laid down onto the conveyor 3 and moving forwards in the direction of arrow f3 towards means (generally designated 5) which provide for lifting each pile from the conveyor 3 and moving it in the direction f, by means of a pusher 6, towards the packaging machine (not shown and known per se).

Numeral 7 generally indicates the means provided for separating each stack P from the next one and discharging said stack from the column onto the horizontal conveyor 3. The means 7 are illustrated in detail in FIGS. 2 and 3.

Figure 3A:
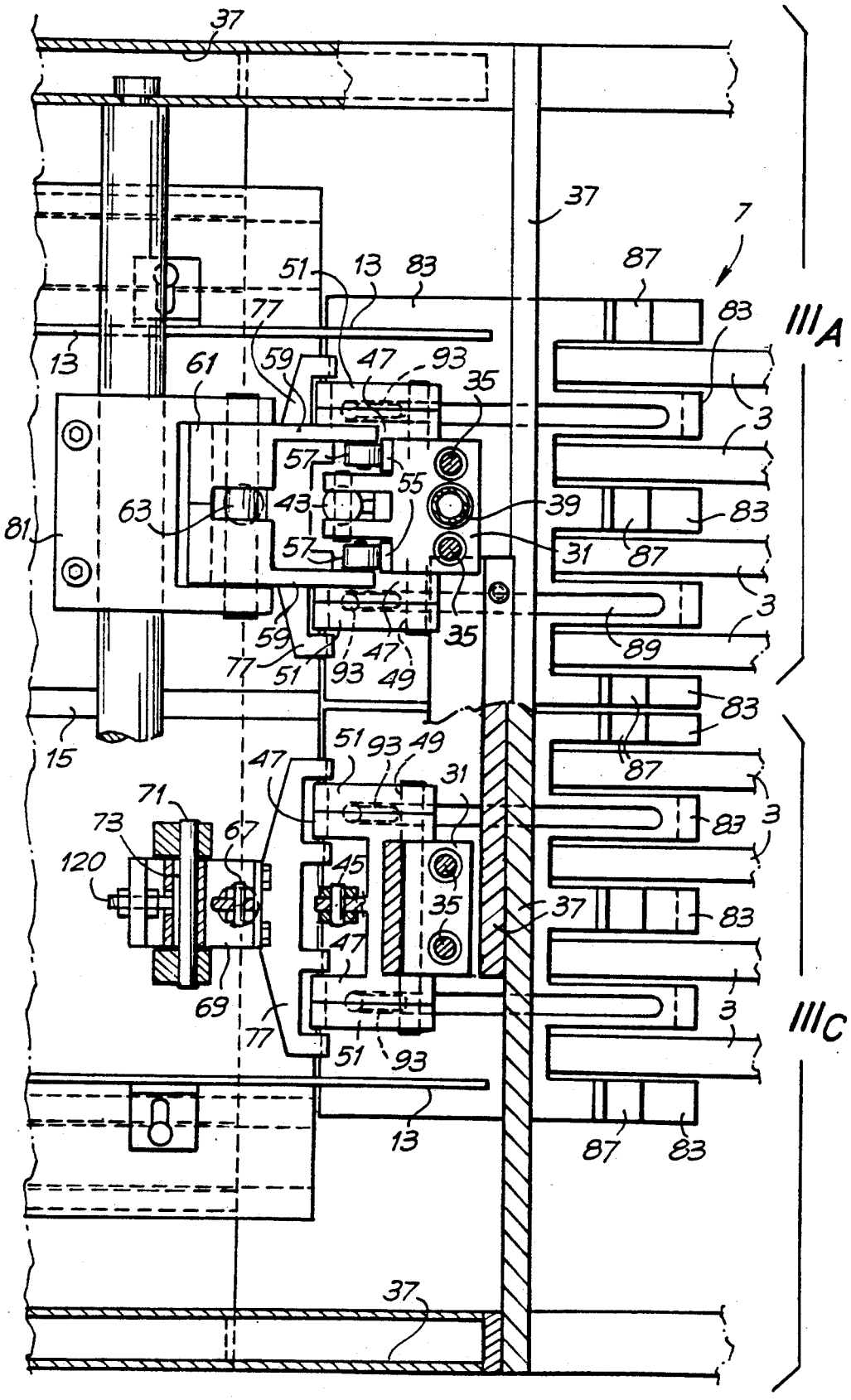
Figure 3B:
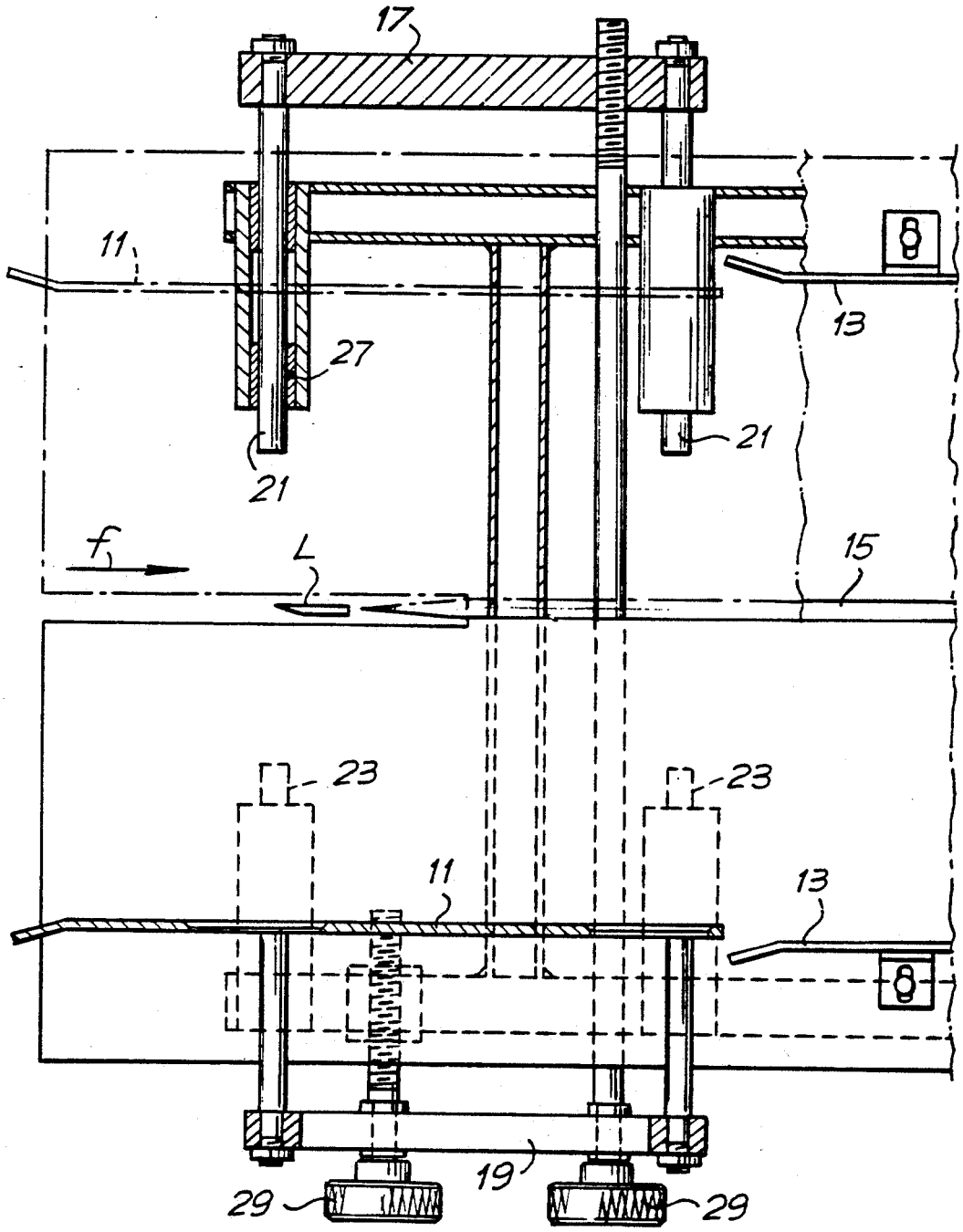

As can be seen in particular in the plan view shown by FIG. 3B, the apparatus is able to handle two columns of articles coming from a single manufacturing machine, and this because these articles are manufactured by cutting a bellows-like folded paper web along a vertical plane, so as to create two columns of double-folded articles simultaneously.

The longitudinally and bellows-like folded web material arriving in the direction of arrow f (FIG. 3B), is pushed against a blade L provided with a vertical cutting edge which severs the folded web material in two columns. The cut material is guided between outer side panels 11, 13 and by an intermediate longitudinal wall 15 parallel to the side panels 11 and 13, which keeps the two columns of articles spaced apart a they are fed to the separating and discharging means generally indicated by 7. As shown in FIG. 3B, the side panels 11 are supported by movable elements 17 and 19 provided with guide bars 21 and 23 sliding within corresponding bushes 27. Disposed on the side of the apparatus are handwheels 29 for changing the position of the side panels 11 and setting them to the width of the manufactured articles.

As clearly shown in FIG. 3A the apparatus has two similar sections for handling the two parallel columns of articles separated by the blade L. FIG. 3A is a view taken on two spaced-apart horizontal planes. The position of the sectioning planes is roughly indicated by the lines II—III and IIIC—IIIC of FIG. 2. For each stack of articles a slide member 31 (see FIGS. 2 and 4–12) is provided which is guided by bushes 33 along a pair of guide bars 35 carried by the fixed frame 37. Arranged above the slide member 31 and between the bars 35 is a cylinder-piston actuator 39 which controls the lifting and lowering movement of the slide 31 for the purposes to be indicated hereinafter. The vertical position of the guide bars 35 is adjustable by means of screw members 41.

Positioned on each slide 31 (see FIG. 2) is a relevant cylinder-piston system 43 whose piston-rod is pivoted at 45 to a fork member 47 hereinafter referred to as oscillating separator member. The oscillating separator member 47 is pivoted to the slide 31 through a pivot pin 49 and may be driven into oscillation with respect to the slide 31 by the cylinder-piston actuator 43. The oscillating separator member 47 is provided with two substantially wedge-shaped, downwardly extending appendixes 47A. The slide 31 (see FIG. 3A) carries a further but non-oscillating separator member 51, whose shape is substantially the same as that of the oscillating separator member 47, but which is not movable with respect to the slide 31 and is rigidly connected to the latter.

Each slide 31 carries a dual cam profile 55 cooperating with a dual wheel tappet 57 borne by an arm 59 of a rocker member 61 which is, in turn, pivotally engaged to the fixed frame 37 of the apparatus through a pin 63. Engaged on the rocker member 61 is a cylinder-piston system 65 whose piston-rod is pivoted at 67 to a support 69 (see FIG. 3-IIIC) engaged with the fixed frame 37 by means of a pin 71 which goes through a slot 73 of the support 69. In this way, the support 69 is connected to the framework 37 of the apparatus with a double degree of freedom.

The support 69 is also connected, via tension spring 75, to a portion 61A of the rocker member 61 and to the piston-rod of the cylinder-piston system 65, as above mentioned. The support 69 carries a series of retaining teeth 77 which engage the upper edge of each stack of articles during the operation for the separation of the preceding stack. The rocker member 61 is acted upon by a compression spring 79 which reacts against a portion 81 which is fixed to the frame 37 of the apparatus. The spring 79 ensures that the tappet 57 is always in contact with the cam profile 55 of slide 31.

Arranged below each slide 31 (see FIG. 2) is an oscillating pusher member 83 pivoted at 85 to the apparatus frame. Each oscillating member 83 carries a set of three fixed abutments 87, whose position can be adjusted according to the dimensions of the articles to be handled. The member 83 carries cylindrical guiding bars 89 for a carriage 91 movable in the direction of arrow f91 (FIG. 2) and carrying pairs of movable abutments 93. Each carriage 91 is connected to a first end of a long tension spring 95 whose second end is connected to a slide 97 movable along guide bars 99 (see FIGS. 4–12), the latter being secured to the structure of the apparatus. The slide 97 is connected to the piston rod of a cylinder-piston system 101 for the purposes to be indicated below. The spring 95, of remarkable extension, is partially guided by a tubular sheath 103 (FIG. 2) and by a transmission pulley 105 whose axis of rotation is coincident with the pivot axis 85 of the oscillating member 83.

The operation of the apparatus will now be illustrated with reference to FIGS. 4 to 12, which schematically show various successive positions taken up by the members of the apparatus during the operations for the discharge of a stack P of articles onto the conveyor 3.

Figure 4:
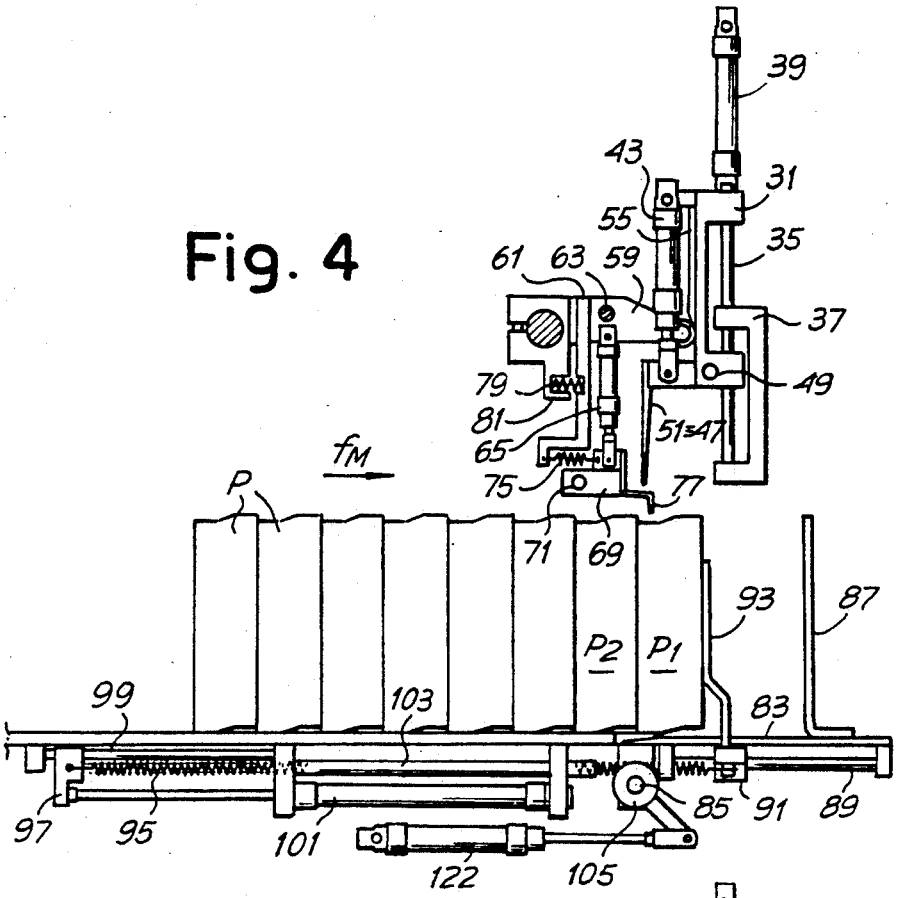

FIG. 4 shows the apparatus prior to the initial step of separation and discharge of a stack P of articles. The slide 31 is in a lifted position and the cylinder-piston 43 is in a retracted position, so that the separating member 51 is in the same position as the oscillating member 47, and the retaining teeth 77 are in lifted position held by the cylinder-piston actuator 65, the latter being in a retracted position as well. The tappet 57 is in contact with the cam profile 55 of the slide 31 in the lower position of same profile.

The first stack of articles (indicated by Pl) coming from the manufacturing machine abuts against the movable abutment 93 which moves forward gradually (to the right in the direction fM) under the thrust of the articles in the column as they are fed by the manufacturing machine (not shown). The abutment 93 is kept pressed against the pile of articles by the spring 95.

Figure 5:
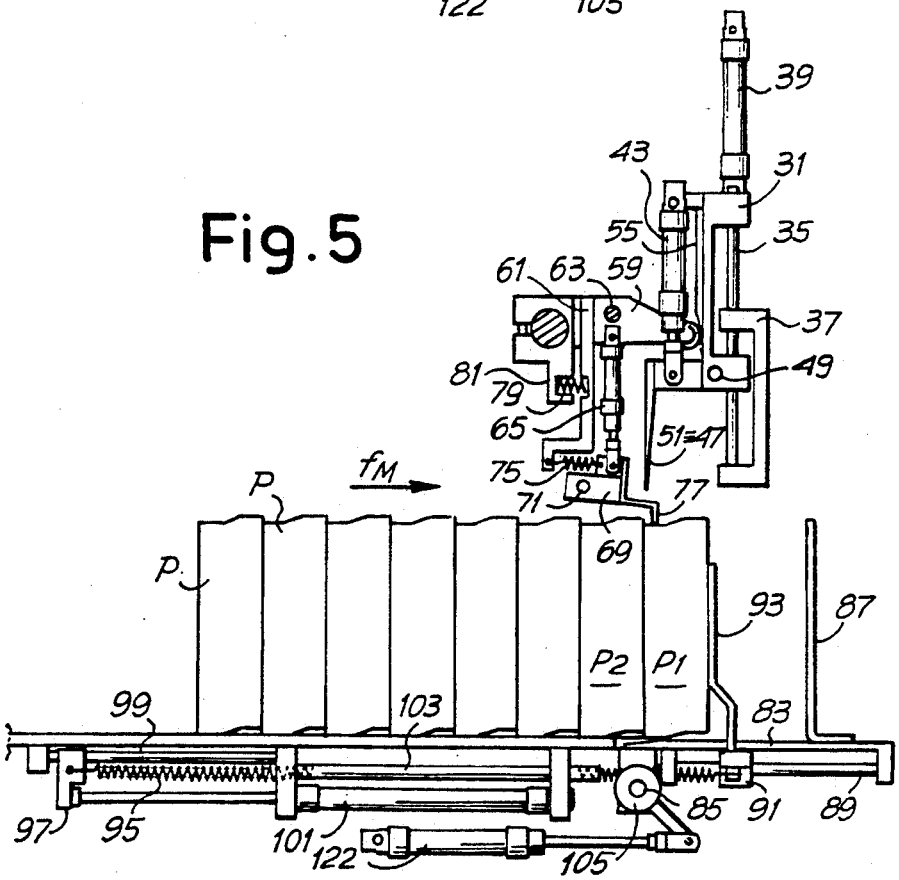

When the upper edge of the second stack P2 moves close to the teeth 77, the latter are rotated about the pin 71 by the cylinder-piston actuator 65, to take up the position illustrated in FIG. 5. Under these conditions, the teeth 77 are at such a position as to restrain the advancement of the upper edge of the second stack of articles P2, while the slide 31 is still at the lifted position and the cylinder-piston system 43 is still in retracted position. The first stack P of articles continues to advance in the direction of arrow fM by virtue of the thrust operated by the column of fed articles.

Figure 6:
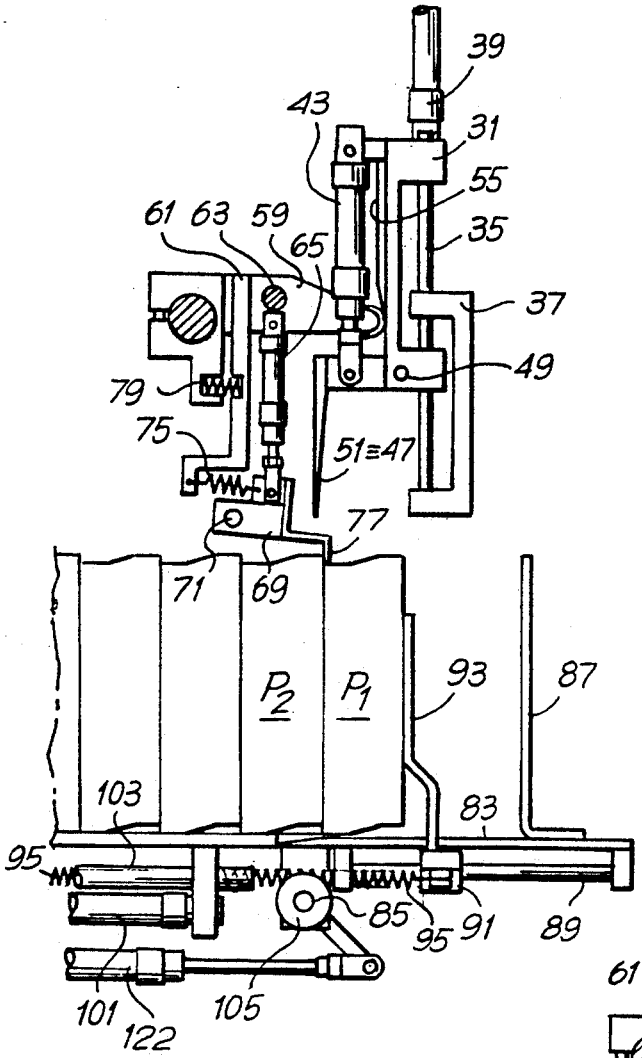

FIG. 6 shows the position in which the teeth 77 come in contact with the upper edge of the stack P2. The other members of the apparatus have not changed their position with respect to what has been previously shown with reference to FIG. 5 with the exception of a slight advancement of the movable abutment 93, corresponding to the advancement of the column of articles M.

Figure 7:
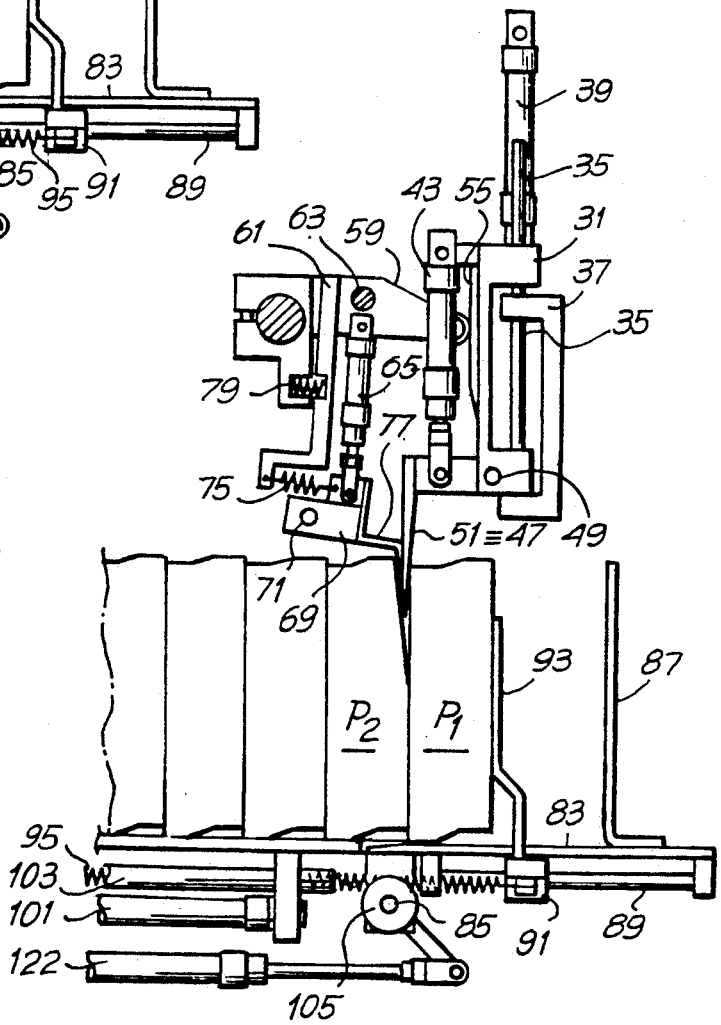

FIG. 7 shows the beginning of the step for the separation of the first stack Pl from the second stack P2. The advancement of the column of articles in the direction fM has caused a displacement of the support 69 of teeth 77 in the direction of advancement of the column of articles. This displacement is made possible by the slot 73 (FIG. 2) wherein the pin 71 extends, which connects the support 69 to the frame of the apparatus. When the support 69 has completed the travel allowed by the slot 73, a proximity sensor 120 (FIG. 2) fixed to the support 69 generates a signal for the operation of the cylinder-piston system 39 which causes the slide 31 to be lowered in the direction of arrow f31 (FIG. 7). This lowering movement causes firstly, through the cam profile 55, an oscillation of the rocker member 59 about its own pivot axis 63. This oscillation movement causes, in turn, an oscillation of the support 69 and thus of teeth 77 which tend to separate the stack P2 from the stack P1. Secondly, the lowering motion of the slide 31 involves the movement of the separator members 47 and 51 into the cleft between the stacks Pl and P2, which has been generated by the oscillation of teeth 77.

Figure 8:
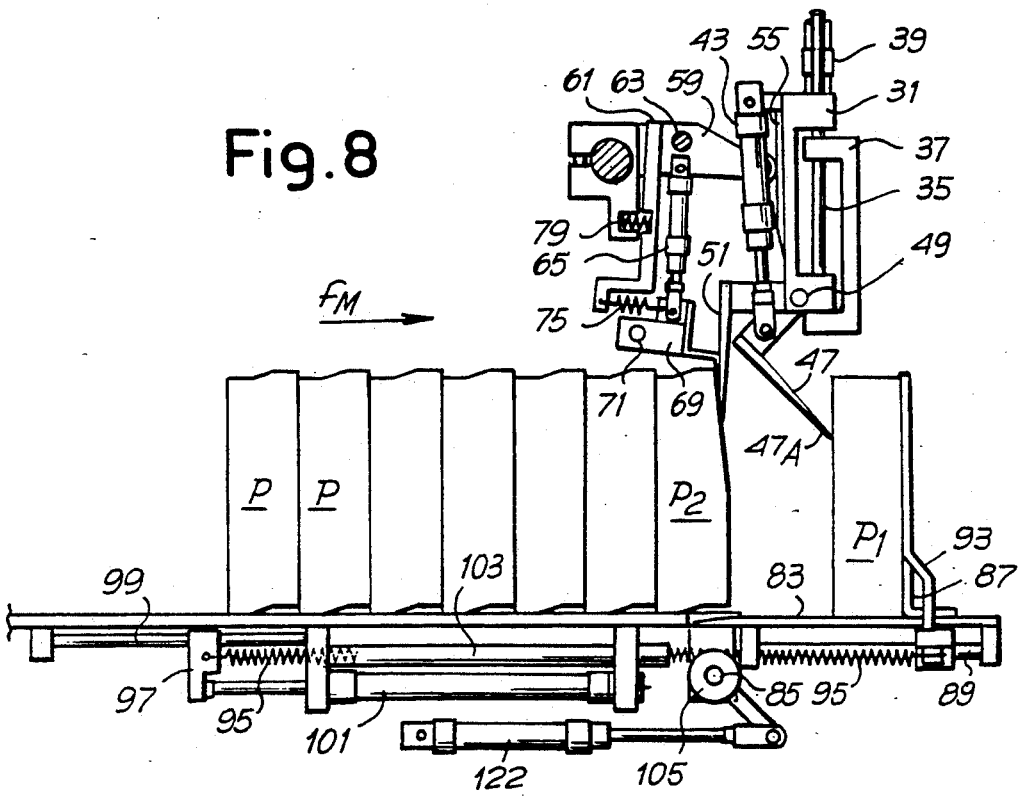

The next step of the process is illustrated in FIG. 8. The cylinder-piston system 43 causes a counter-clockwise movement about the rotation axis 49 of the oscillating separator members 47, while the separator members 51 remain in the vertical position to retain the stack P2 of articles. The oscillation of the oscillating separator members 47 causes the sliding (to the right in FIG. 8) of the first stack of articles P1 against the action of the movable abutment 93 (which is also displaced to the right, as shown in FIG. 8).

The translatory motion terminates when the abutment 93 is brought into alignment with the fixed abutment 87. The translatory motion of the abutment 93 is made easier by a backward movement of the piston-rod of the cylinder-piston system 101 to which one end of spring 95 is engaged. As shown in FIG. 8, under these conditions the column of articles fed by the manufacturing machine is steadily held by the separator member 51, while the first pile of the column has been separated and is securely held by the movable abutment 93, the fixed abutment 87, and by the oscillating separator member 47.

Figure 9:
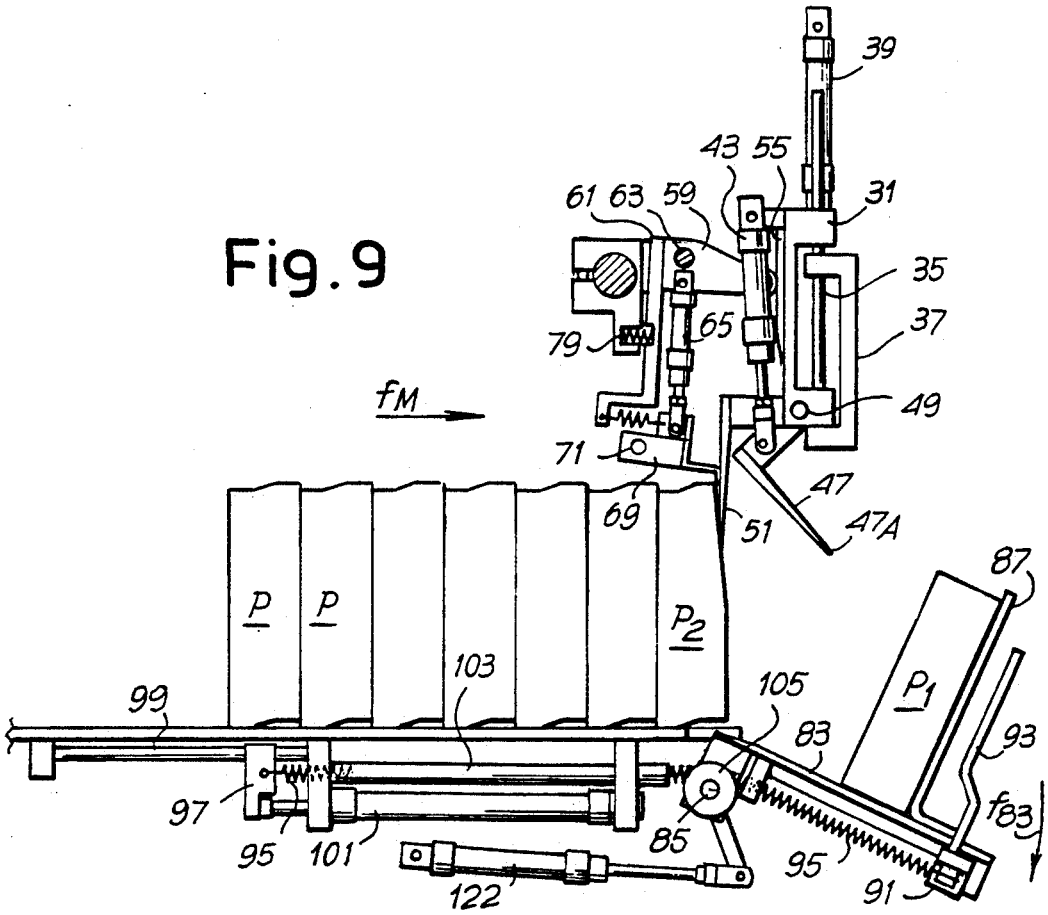

From the position shown in FIG. 8, the stack P1 is discharged onto the conveyor 3 through a clockwise rotation of the oscillating member 83, as shown by arrow f83 in FIG. 9. This rotation is affected by a cylinder-piston system 122 and requires a further backward stroke of the piston-rod of the cylinder-piston system 101. During the rotation of the oscillating member 83, the spring 95 is moved around the pulley 105.

Figure 10:
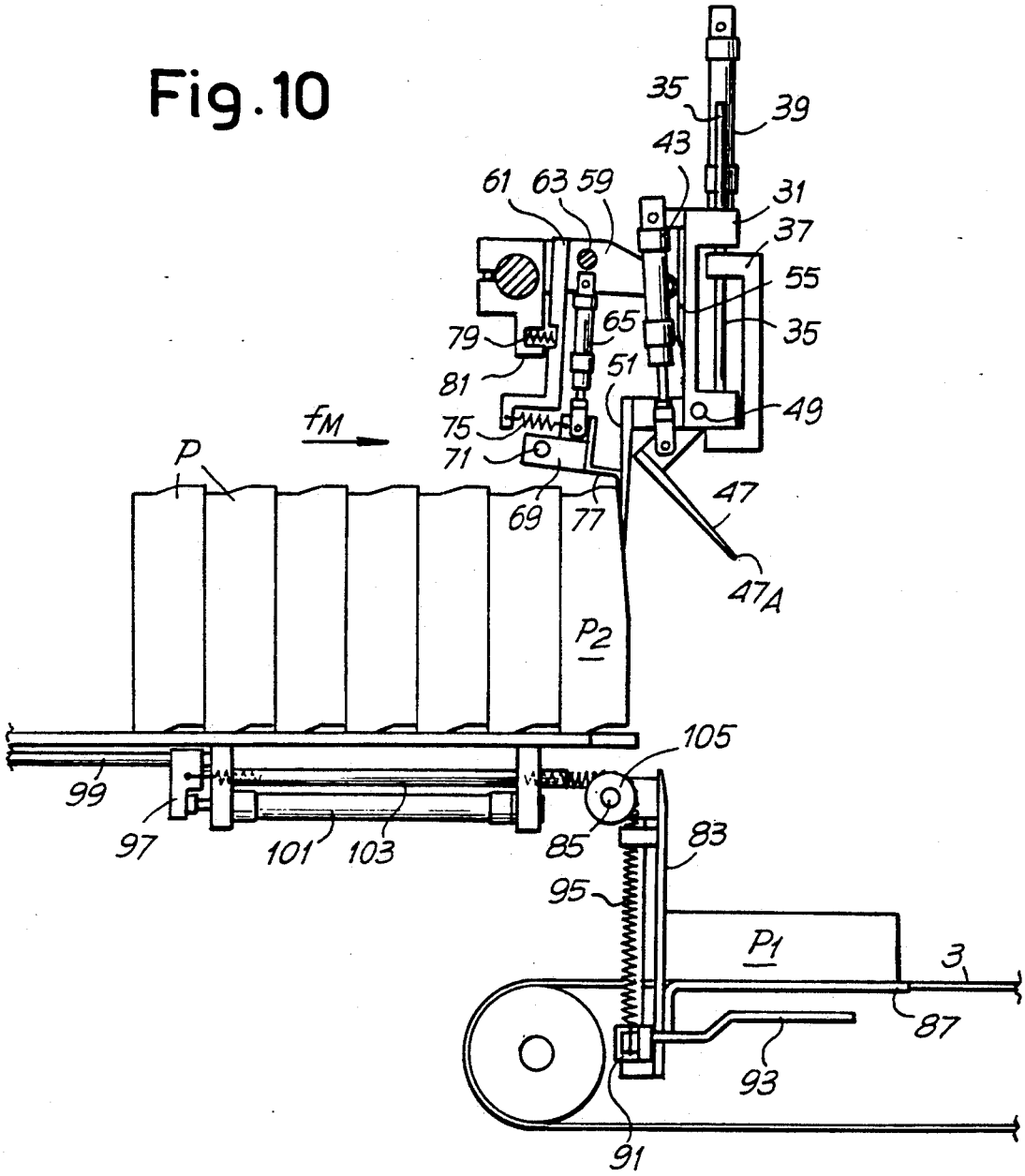

FIG. 10 shows the final position at the end of a 90° rotation of the oscillating member 83 which brings the stack P1 to lie as a pile on a belt system forming the conveyor 3, while the fixed abutment 87 and the movable abutment 93 pass below the belts of said conveyor 3. The other members of the apparatus have not modified their positions, as shown in the upper part of FIG. 10.

Figure 11:
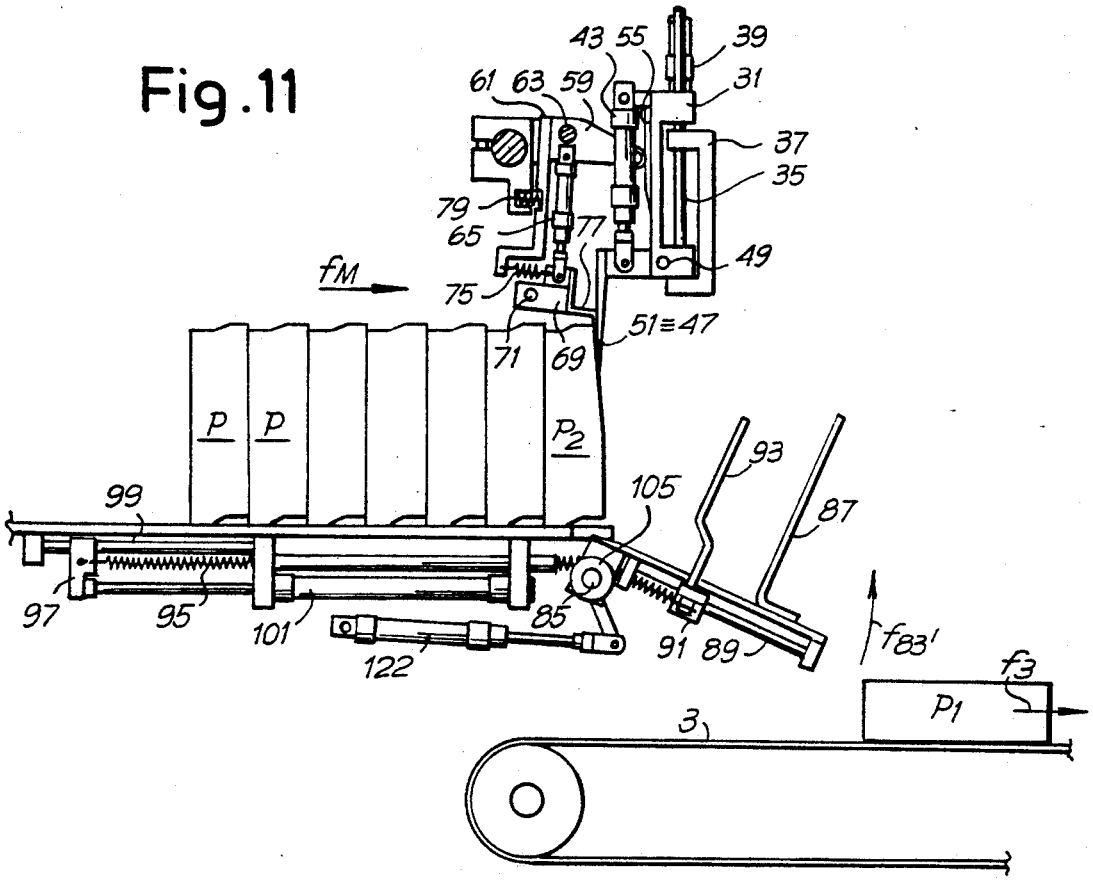

FIG. 11 shows the return step of the oscillating member 83 which returns to the horizontal position through a counter-clockwise rotation indicated by f83'. The counter-clockwise rotation of the oscillating member 83 is accompanied by a forward stroke of the piston-rod of the cylinder-piston system 101, which keeps the spring 95 in tension. In the meantime, the cylinder-piston member 43 has brought the oscillating separator member 47 back to its vertical position which coincides with the position of the separator member 51.

Figure 12:
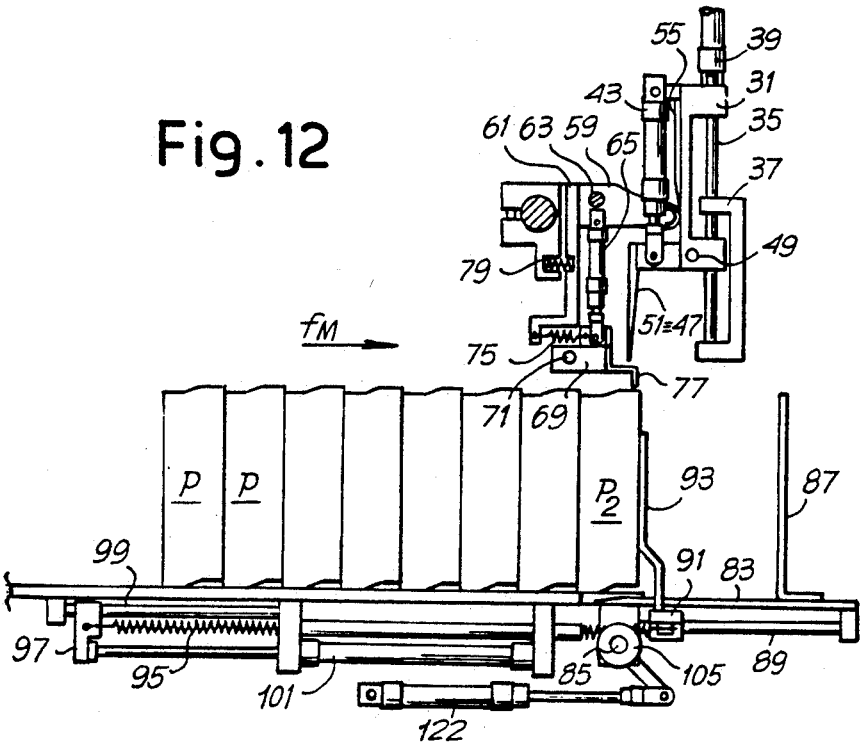

In FIG. 12 the apparatus members are again shown in their resting position being obtained by rotating the retaining teeth 77 about the pin 71 by means of the cylinder-piston system 65, and by bringing the slide 31 back to the lifted position by means of the actuator 39. The movable abutment 93 has been meanwhile brought against the front surface of the stack of articles P2 which continues to advance and which will be the subsequent stack to be discharged onto the conveyor 3. In the meantime, the previously discharged pile P1 moves in the direction f3 towards the packaging machine.

In the position shown in FIG. 12, the apparatus is ready to restart the cycle for the discharge of the subsequent stack P2.

It is understood that the drawing shows an exemplification given only as a practical demonstration of the invention, as this may vary in the forms and dispositions without nevertheless coming out from the scope of the idea on which the same invention is based. The possible presence of reference numbers in the appended claims has the purpose to facilitate the reading of the claims, reference being made to the description and the drawing, and does not limit the scope of the protection represented by the claims.

Having thus described the invention, what is claimed as new and desired to protect by Letters Patent are the following:

1. Apparatus for transferring stacks of folded articles such as serviettes or the like, from an advancing column of articles onto a conveyor (3), said apparatus including retaining teeth (77) to restrain the first article in a stack (P), in the column M, which teeth are moved by the advancement of the articles, separator means to separate a first stack (P1) of articles from a subsequent stack (P2), and discharge means (83) to discharge each stack onto the conveyor (3); wherein: said separator means includes a first separating member (51), able to penetrate between the first and the subsequent stacks (P1, P2) of articles, and a second separating member (47) operating in conjunction with the first separating member (51) to move between the two adjacent stacks (P1 and P2) of articles and which additionally moves the first stack (P1) away from the subsequent stack (P2) and supports it prior to the discharge thereof towards the conveyor (3); and wherein the discharging means includes an oscillating means (83) carrying an abutment (93) which can be moved parallel to the motion of the column and of the stacks.

2. Apparatus according to claim 1, wherein said second separating means (47) is provided with an oscillation motion relative to the first separating member (51).

3. Apparatus according to claim 1 or 2, wherein the discharging means includes an oscillating means (83) carrying an abutment which can be moved parallel to the motion of the column and of the stacks.

4. Apparatus according to claim 1, wherein said oscillating member (83) includes a second fixed abutment (87).

5. Apparatus according to claim 3, characterized in that said movable abutment is carried by a carriage (91) movable along corresponding guide means (89), and an actuator (101) is connected to said carriage through resilient return means (95).

6. Apparatus according to claim 1 or 2, wherein said retaining teeth (77) are provided with a first motion to enter in contact with the first article of each stack (P) and with a second motion to partially separate two adjacent stacks of articles.

7. Apparatus according to claim 6, including two actuator means associated to said retaining teeth, the first (65) of which moves said teeth into contact with the first article of the relevant stack, while the second (39, 55, 57) controls an oscillatory motion of said teeth to partially separate the stack (P2), with which said teeth are in contact from the preceding stack (P1).

8. Apparatus according to claim 7, wherein said retaining teeth 77 are borne by a support (69) connected to the bearing structure (37) of the apparatus with two degrees of freedom, which support is resiliently connected to a rocker (61) carrying said tappet (57), the first actuator (65) associated to said retaining teeth being engaged to said rocker.

9. Apparatus according to claim 1 or 2 including a slide (31) carrying first and second separating members (51, 47), and which is vertically movable to cause the penetration of said separating members between two adjacent stacks (P1) and (P2) of articles, and which is provided with actuators (43) disposed thereon for driving the said second separating member (47) into motion.

10. Apparatus according to claim 9, wherein said slide (31) carries a cam profile (55) cooperating with a tappet (57) connected to said retaining teeth (77), the motion of said slide causing the oscillatory motion of the retaining teeth.

11. Apparatus according to claim 10, wherein said retaining teeth (77) are borne by a support (69) connected to the bearing structure (37) of the apparatus with two degrees of freedom, which support is resiliently connected to a rocker (61) carrying said tappet (57), the first actuator (65) associated to said retaining teeth being engaged to said rocker.

12. Method for individually transferring stacks (P) of folded articles, such as serviettes or the like, from a column of such articles, to a conveyor (3), including the steps of:

advancing a column (M) of stacks (P) toward a movable abutment (93);

separating the first stack (P1) from the subsequent stack (P2) of the column (M) by temporarily retaining the leading edge of the subsequent stack (P2) by means of a retaining tooth (77);

penetrating a first and a second separator means (51; 47) between the first and the subsequent stack;

transferring the first stack to the conveyor (3) by advancing and rotating said first stack, said first stack being temporarily held between the movable abutment (93) and the second separator means (37);

placing said first stack onto said conveyor (3);

rotating and retracting the abutment (93) to place it in contact with the front surface of the subsequent stack (P2);

withdrawing said first and second separator means (51; 47).

13. Method according to claim 12, characterized by separating the stack to be discharged from the column by a translatory motion during which it is held, on both the sides which are perpendicular to the advancement direction of the column, by members (47, 93) which follow the translatory motion of the stack (P1), rotating the latter and discharging it onto the conveyor at the end of said translator motion.

* * * * *